US007059882B2

(12) United States Patent
Sugita et al.

(10) Patent No.: US 7,059,882 B2
(45) Date of Patent: Jun. 13, 2006

(54) CONNECTOR HAVING FLOATING STRUCTURE

(75) Inventors: Masahiro Sugita, Sumoto (JP); Shimako Yamada, Sumoto (JP)

(73) Assignee: Sanyo Electric Co., Ltd., Osaka (JP)

( * ) Notice: Subject to any disclaimer, the term of this patent is extended or adjusted under 35 U.S.C. 154(b) by 32 days.

(21) Appl. No.: 11/199,086

(22) Filed: Aug. 9, 2005

(65) Prior Publication Data

US 2006/0035500 A1 Feb. 16, 2006

(30) Foreign Application Priority Data

Aug. 11, 2004 (JP) ..... 234763/2004

(51) Int. Cl.
*H01R 13/64* (2006.01)

(52) U.S. Cl. ..... 439/247; 439/248

(58) Field of Classification Search ..... 439/246–248
See application file for complete search history.

(56) References Cited

U.S. PATENT DOCUMENTS 6,159,030 A * 12/2000 Gawron et al. ..... 439/247
6,234,817 B1 * 5/2001 Hwang ..... 439/247

FOREIGN PATENT DOCUMENTS

| | | |
|---|---|---|
| EP | 1 329 992 | 7/2003 |
| JP | 8-31510 | 2/1996 |

* cited by examiner

*Primary Examiner*—Tho D. Ta
(74) *Attorney, Agent, or Firm*—Wenderoth, Lind & Ponack, L.L.P.

(57) ABSTRACT

A connector having a floating structure includes a floating holder 4 for coupling a fitting coupling portion 5 connected to a portable electrical apparatus 30 to a base 3 through a floating mechanism 10. The floating holder 4 is molded of plastic as a separate part from a connector main body 2 provided with the fitting coupling portion 5. The floating holder 4 has a first holder 4A and a second holder 4B for pinching and supporting a coupling deck 8 of the connector main body 2 from opposite sides. The first holder 4A and the second holder 4B have locking hooks 18, 19 and are coupled to each other directly or through the connector main body 2. Moreover, the first holder 4A and the second holder 4B have integrally molded support portions 16, 22 for supporting the coupling deck 8 of the connector main body 2.

18 Claims, 7 Drawing Sheets

4B • • SECOND HOLDER 7 • • CONTACT

4 • • FLOATING HOLDER
5 • • FITTING COUPLING PORTION
6 • • CONNECTION TERMINAL
8 • • COUPLING DECK
10 • • FLOATING MECHANISM
11 • • COUPLING HOLE
14 • • CIRCUIT BOARD
16 • • SUPPORT PORTION

4B • • SECOND HOLDER 7 • • CONTACT

CONNECTOR HAVING FLOATING STRUCTURE

BACKGROUND OF THE INVENTION

1. Field of the Invention

The present invention mainly relates to a connector connected to a portable electrical apparatus such as a cellular phone and a digital camera and particularly to a connector having a floating mechanism, the connector being freely movable in a predetermined range when connected to the portable electrical apparatus.

2. Description of the Related Art

FIG. 1 is a schematic view of a state in which a portable electrical apparatus 30 is connected to a connector 41 having a floating structure. The connector 41 is connected to the base 46 by putting elastic rings 44 which are deformable rubber-like elastic bodies into through holes 43 in a floating deck 42 integrally provided to a connector main body 40 and provided to a lower portion of the main body 40 and inserting setscrews 45 inserted into the elastic rings 44. The connector 41 of this structure is fixed to the base 46 through the structure which is movable by deforming the elastic rings 44. The connector having the floating structure is connected to a printed circuit board 48 through a flexible board 47. The flexible board 47 connects the connector 41 to the printed circuit board 48 in a state in which the connector 41 is movable. In order to connect the flexible board 47, a circuit board 49 is fixed to a lower end of the connector 41 by soldering. To this circuit board, the flexible board is connected.

The connector shown in FIG. 1 is characterized in that it can reliably be connected to a coupling portion of the portable electrical apparatus to reduce a poor connection. This is because the connector moves to such a position as to reliably be connected to the coupling portion of the portable electrical apparatus. Especially in the structure shown in the drawing, in which the portable electrical apparatus is set by being placed in a concave portion formed in a case or on a mounting portion on the case and is connected to the portable electrical apparatus, relative positions of the portable electrical apparatus and the connector may be displaced from each other in some cases. If the relative positions of them are displaced from each other, the coupling portion of the portable electrical apparatus cannot be inserted into an accurate position of the connector. As a result, it is difficult to reliably connect all contacts of the connector and the coupling portion without contact failure. Particularly in a structure in which the connector connects not only a power source but also many communication channels, it is difficult to reliably connect all contacts. With the connector having the floating structure, this drawback can be overcome by moving the relative positions of the connector and the coupling portion of the portable electrical apparatus to optimum positions.

As described above, there has been developed the connector which can be coupled to the base through the floating structure (see a gazette of Japanese Patent Publication Laid-open No. 8-31510).

SUMMARY OF THE INVENTION

In the connector described in this gazette, as shown in FIG. 2, a floating deck to which a floating spring is coupled is provided to a lower portion of a fitting coupling portion. In the connector 51 having this structure, the fitting coupling portion 52 and the floating deck 53 are provided as an integral structure. However, the connector 51 having this structure has a drawback that the floating deck 53 provided for coupling through the floating structure interferes with connection of a circuit board 54 to a lower end of the connector 51. The floating deck also interferes with inspection for and mend of poor soldering. As a result, if the circuit board cannot be soldered normally to connection terminals, both the connector and circuit board have to be discarded together, which reduces yields.

The present invention has been developed to overcome such drawbacks. It is an important object of the invention to provide a connector having a floating structure in which poor soldering of the connection terminals can be prevented to minimize waste due to the poor soldering.

It is another important object of the invention to provide a connector having a floating structure in which a connector main body provided with a fitting coupling portion and a floating deck can easily and firmly be coupled.

A connector having a floating structure according to the present invention comprises: a plurality of connection terminals 6 for soldering and provided to a lower portion; a fitting coupling portion 5 having contacts 7 to be coupled to the connection terminals 6 to be connected to a portable electrical apparatus 30; and a floating holder 4 for coupling the fitting coupling portion 5 to a base 3 through a floating mechanism 10. The connection terminals 6 and the fitting coupling portion 5 are provided to a connector main body 2. The floating holder 4 is molded of plastic as a separate part from the connector main body 2 independently of the connector main body 2. The connector main body 2 has a coupling deck 8 for coupling the floating holder 4 at its lower portion. The floating holder 4 includes a first holder 4A and a second holder 4B for pinching and supporting the coupling deck 8 of the connector main body 2 from opposite sides. The first holder 4A and the second holder 4B have integrally molded locking hooks 18, 19 to be coupled to each other directly or through the connector main body 2 while pinching the coupling deck 8 of the connector main body 2. The first holder 4A and the second holder 4B have integrally molded support portions 16, 22 for supporting the coupling deck 8 of the connector main body 2 when the holders 4A, 4B are coupled while pinching the coupling deck 8 of the connector main body 2. In the connector, the connector main body 2 is pinched between the first holder 4A and the second holder 4B of the floating holder 4 and the floating holder 4 is coupled to the base 3 through the floating mechanism 10.

The above connector having the floating structure has an advantage that waste due to poor soldering can be minimized while preventing the poor soldering of the connection terminals. This is because the connector includes the connector main body having the fitting coupling portion to be coupled to the portable electrical apparatus and the floating holder for coupling the fitting coupling portion to the base through the floating mechanism and the floating holder can be separated from the connector main body as the separate part from the connector main body. The floating holder includes the first holder and the second holder for pinching and supporting the coupling deck of the connector main body from opposite sides. The first holder and the second holder have locking hooks and the first holder and the second holder are coupled to each other directly or through the connector main body. Consequently, it is possible to couple the floating holder to the base through the floating mechanism while easily and firmly coupling the connector main body provided with the fitting coupling portion and the floating holder. In the connector having the above structure, interference of the floating holder can be prevented in soldering of the connection terminals of the connector main body to the circuit board. As a result, it is possible to extremely efficiently and normally solder the connection terminals to the circuit board while minimizing waste due to poor soldering of the connection terminals.

Because the floating holder is formed as the separate part from the connector main body, it is possible to form the floating holders having structures adapted to various bases while using the common connector main bodies, which contributes versatility as compared with a structure having the connector main body integral with the floating holder.

In the connector according to the present invention, (a) coupling hole(s) 11 for coupling to the base 3 through a floating structure may be formed in one or both of the first holder 4A and the second holder 4B of the floating holder 4.

In the connector of the present invention, the connection terminals 6 may be terminals to be coupled by soldering to a circuit board 14.

In the connector of the present invention, an outside shape of the fitting coupling portion 5 of the connector main body 2 may be a rectangular pole having a rectangular plan shape and the locking hooks 18 of the first holder 4A may pinch shorter sides of the rectangle on opposite sides to lock the fitting coupling portion 5.

In the connector of the present invention, the locking hook 119 of the second holder 4B may be locked to the first holder 4A to couple the second holder 4B to the first holder 4A.

The above and further objects and features of the invention will more fully be apparent from the following detailed description with accompanying drawings.

DETAILED DESCRIPTION OF THE PREFERRED EMBODIMENTS

Figure 1:
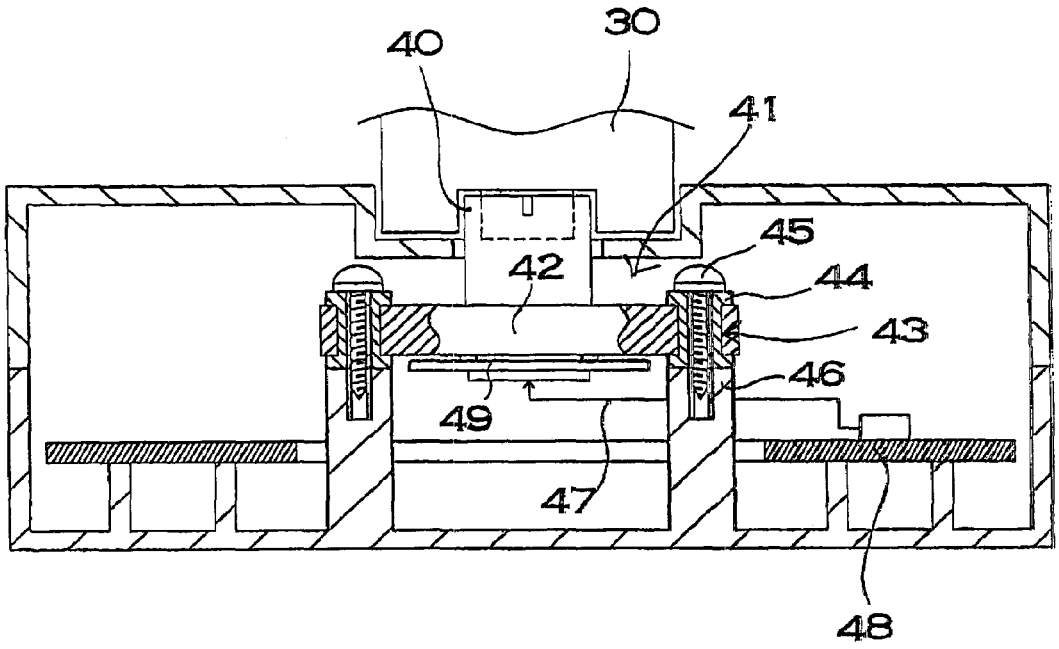
FIG. 1 is a schematic view of a state in which a portable electrical apparatus is coupled to a prior art connector having a floating structure.
Figure 2:
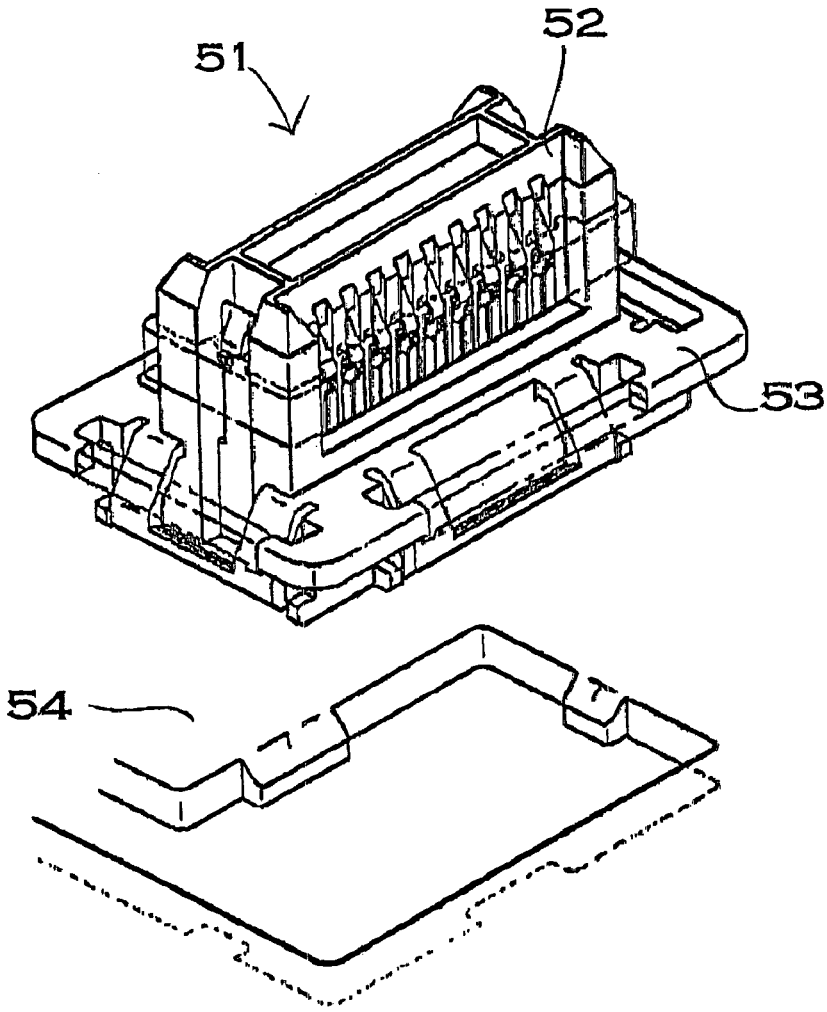
FIG. 2 is a perspective view showing another example of the prior art connector having the floating structure.
Figure 3:
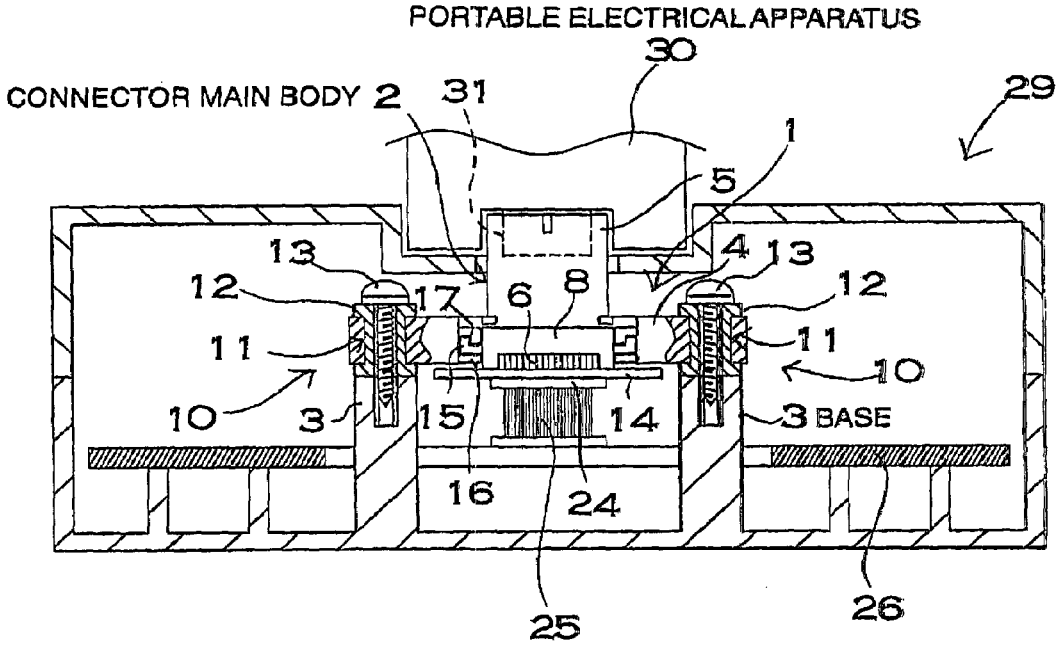
FIG. 3 is a schematic view of a state in which a portable electrical apparatus is coupled to a connector having a floating structure according to an embodiment of the present invention.

FIG. 3 shows a power supply table 29 of a portable electrical apparatus including a connector having a floating structure. The portable electrical apparatus 30 is coupled onto the power supply table 29. A coupling portion 31 provided to a lower face of the coupled portable electrical apparatus 30 is connected to a connector 1 of the power supply table 29. The power supply table 29 supplies electric power through the connector 1 and the coupling portion 31 to the portable electrical apparatus 30. The electric power supplied to the portable electrical apparatus 30 is supplied as power from a power source for operating the portable electrical apparatus 30 and also charges a secondary battery mounted in the portable electrical apparatus 30. The power supply table 29 is connected to the portable electrical apparatus 30 through the connector 1 and a plurality of contacts 7 provided to the coupling portion 31 to send/receive information to and from the portable electrical apparatus 30 and to supply electric power for operation and charging.

In the power supply table 29 in this drawing, the connector 1 is coupled to a base 3 through a floating mechanism 10. The floating mechanism 10 couples the connector 1 to the base 3 through elastic rings 12 which are rubber-like elastic bodies put into coupling holes 11 of the connector 1 so that the connector 1 can be moved. The elastic rings 12 are in tubular shapes having flanges on their opposite ends and are inserted into the coupling holes 11 while prevented from withdrawing. Setscrews 13 inserted into the elastic rings 12 couple the connector 1 to the base 3.

The connector 1 in FIG. 3 is shown in FIGS. 4 to 7. In the connector 1 shown in these drawings, a plurality of connection terminals 6 for soldering are provided to a lower end and contacts 7 to be coupled to the connection terminals 6 and connected to the portable electrical apparatus 30 are provided to a fitting coupling portion 5. In order to couple the fitting coupling portion 5 to the base 3 through the floating mechanism 10, a floating holder 4 is provided.

In the connector 1, the connection terminals 6 and the fitting coupling portion 5 are provided to a connector main body 2. Independently of the connector main body 2, the floating holder 4 is molded of plastic as a part separate from the connector main body 2.

The connector main body 2 is formed by integrally molding the fitting coupling portion 5 and a coupling deck 8 of plastic. In the connector main body 2 in the drawings, a metal sleeve 9 is fixed in close contact with a periphery of the fitting coupling portion 5. The metal sleeve 9 reinforces the fitting coupling portion 5 and can prevent deformation and distortion of the fitting coupling portion 5 in a state in which the portable electrical apparatus 30 is coupled or not coupled. However, it is not exactly essential to reinforce the fitting coupling portion with the metal sleeve.

The fitting coupling portion 5 of the connector main body 2 in the drawings is molded into an angular cylindrical shape having a rectangular plan shape and has the plurality of contacts 7 at an inner hollow portion. The contacts 7 are formed by fixing pieces of metal wire in vertical orientations and at predetermined intervals. The contacts 7 are connected to contacts of the coupling portion 31 of the portable electrical apparatus 30 coupled to the fitting coupling portion 5. The contacts 7 include power supply contacts for supplying electric power to the portable electrical apparatus 30 and communication contacts for sending/receiving information to and from the portable electrical apparatus 30.

The contacts 7 of the fitting coupling portion 5 are connected to the connection terminals 6 fixed to the lower end inside the connector main body 2. The connection terminals 6 are terminals for soldering and are connected by soldering to a circuit board 14. The plurality of connection terminals 6 are provided at predetermined intervals on opposite sides of the lower end of the rectangular fitting coupling portion 5. The connection terminals 6; are coupled by soldering to the circuit board 14 to electrically connect and physically couple the connector main body 2 to the circuit board 14.

Figure 5:
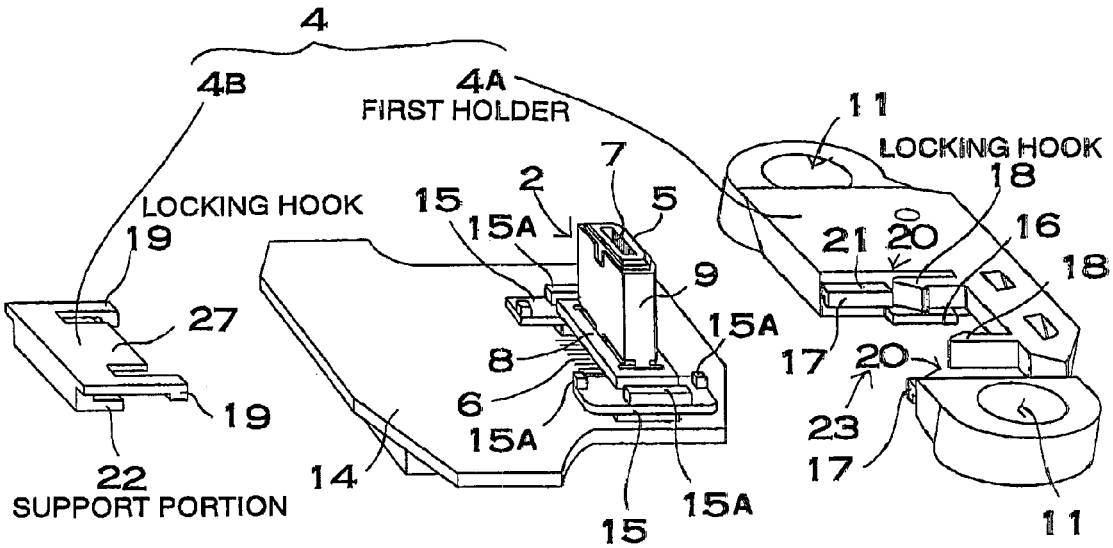
FIG. 5 is an exploded perspective view of the connector shown in FIG. 4.
Figure 6:
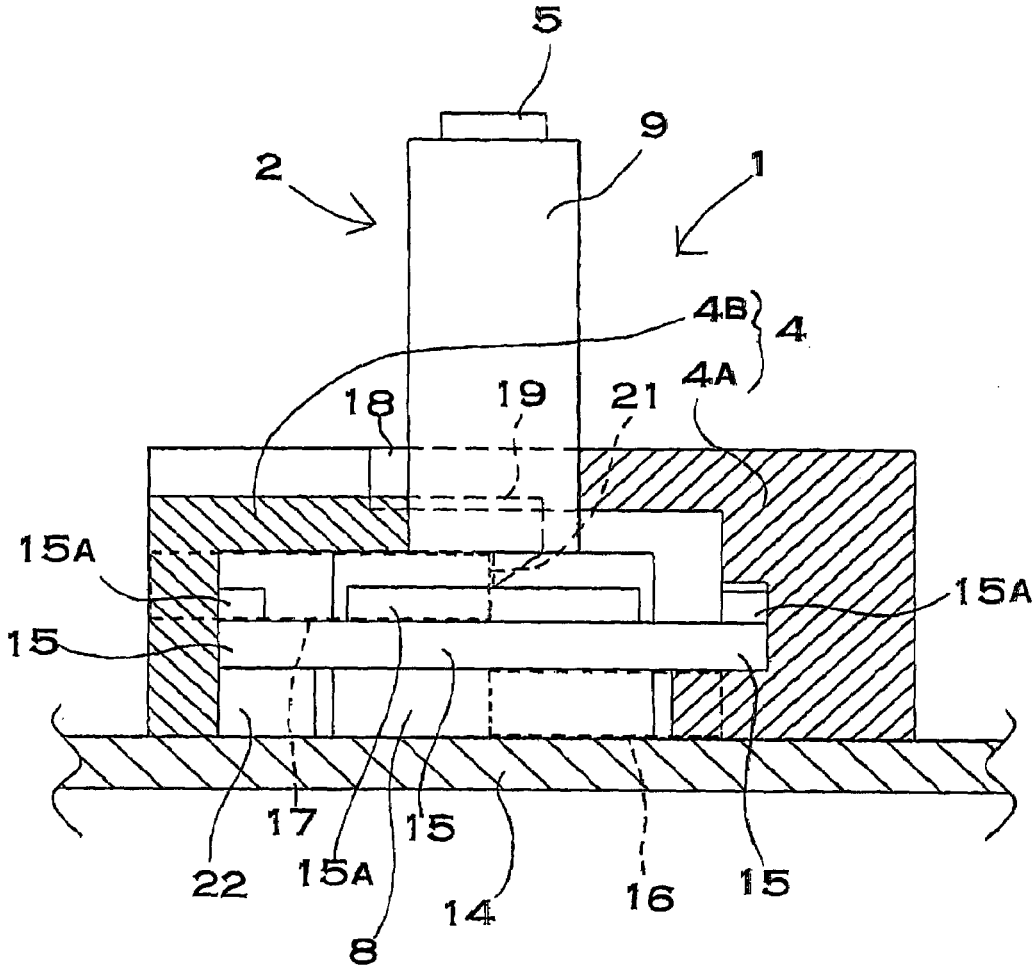
FIG. 6 is a horizontal sectional view of the connector shown in FIG. 4.
Figure 7:
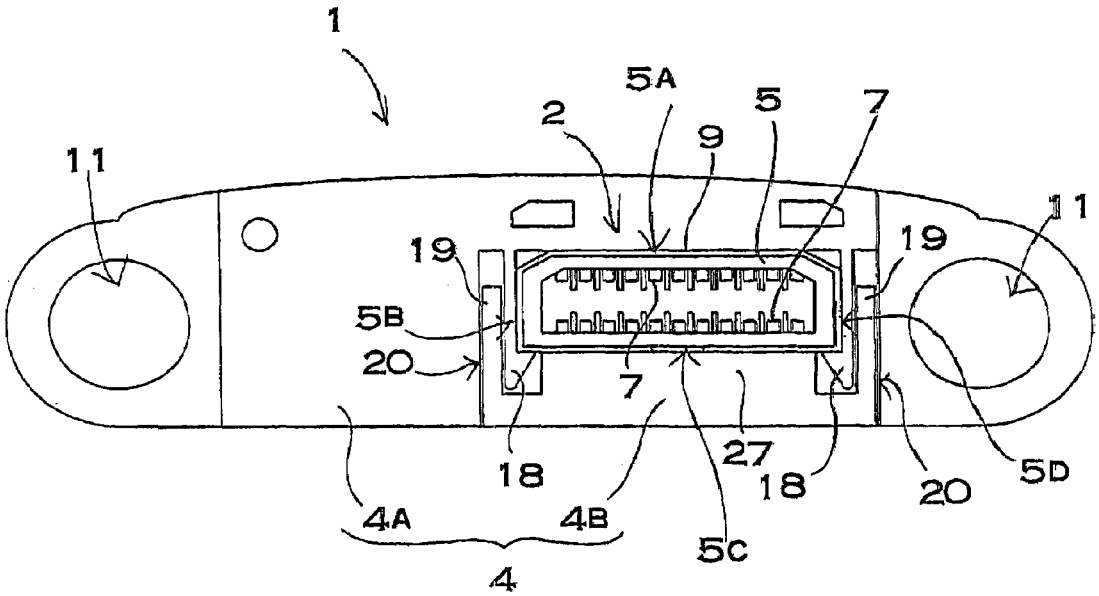
FIG. 7 is a plan view of the connector shown in FIG. 4.

A coupling deck 8 is provided to a lower portion of the connector main body 2. The coupling deck 8, has a larger outside shape than the fitting coupling portion 5 and is provided like a flange under the fitting coupling portion 5. The coupling deck 8 is coupled to the floating holder 4. The coupling deck 8 shown in FIGS. 3 and 6 has integrally molded support ribs 15 protruding from its outer periphery. The support ribs 15 are supported from below by support portions 16 provided to the floating holder 4. In order to guide the support portions 16 toward under the support ribs 15, spaces to which the support portions 16 are to be guided are provided under the support ribs 15 (see FIG. 3). In the coupling deck 8 in the drawing, the support ribs 15 are disposed in positions displaced above from a bottom face to provide the spaces under the support ribs 15. The coupling deck 8 shown in FIG. 5 is provided with the support ribs 15 along shorter sides of the rectangle. The support ribs 15 are also provided from the shorter sides to end portions of the longer sides of the rectangle. Each the support rib 15 shown in FIGS. 3, 5, and 6 has bend chips 15A formed by bending an outer peripheral edge upward. As shown in a sectional view in FIG. 3, the support ribs 15 can be coupled by locking the bend chips 15A with hook ridges 17 integrally molded at the floating holder 4. Each the hook ridge 17 has a downward bend chip at its tip end edge to lock the bend chips 15A of the support rib 15. The support ribs 15 having these structures can reliably be coupled to the floating holder 4 as locking structures.

Because the connector main body 2 and the floating holder 4 have bilaterally symmetrical structures (along a lateral direction in FIG. 3, here), only one side of the bilaterally symmetrical structure may be disclosed in the description of the embodiment and the drawings and the other side having the symmetrical structure may be omitted.

The floating holder 4 includes a first holder 4A and a second holder 4B between which the coupling deck 8 of the connector main body 2 is pinched and supported from opposite sides. The first holder 4A and the second holder 4B pinch the coupling deck 8 of the connector main body 2 and are coupled to each other through locking hooks 18, 19. The locking hooks 18, 19 are integrally molded and provided to the first holder 4A and the second holder 4B made of plastic. The connector 1 shown in the drawings is locked by hooking the locking hooks 18 of the first holder 4A on the fitting coupling portion 5 of the connector main body 2 and hooking the locking hooks 19 of the second holder 4B on the first holder 4A. Accordingly, the first holder 4A and the second holder 4B are coupled together through the locking hooks 18, 19 and are also coupled to the connector main body 2 through the locking hooks 18, 19. However, in the connector of the invention, it is also possible that both the locking hooks of the first holder and the second holder are locked to the connector main body and are coupled together through the connector main body. Moreover, it is also possible that the locking hooks of the first holder are coupled to the second holder and that the locking hooks of the second holder are coupled to the connector main body or the first holder. The first holder 4A and the second holder 4B coupled to each other through the locking hooks 18, 19 are coupled while pinching and retaining the coupling deck 8 of the connector main body 2 from the opposite sides. The first holder 4A and the second holder 4B are coupled to each other while pinching the rectangular fitting coupling portion 5. The rectangular fitting coupling portion 5 has opposed faces on sides of the longer sides as a first face 5A and a third face 5C and opposed faces on sides of the shorter sides as a second face 5B and a fourth face 5D in FIG. 7. The floating holder 4 in the drawings has a structure in which the first face 5A and the third face 5C which are the faces on the sides of the longer sides of the rectangle are pinched between the first holder 4A and the second holder 4B.

Figure 4:
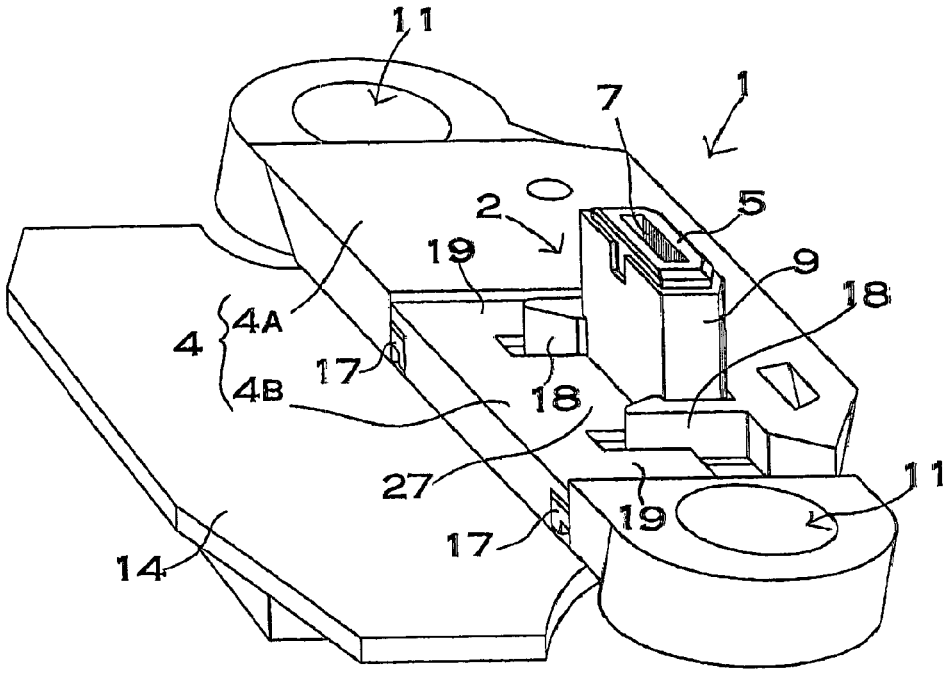
FIG. 4 is a perspective view of the connector shown in FIG. 3.

The first holder 4A shown in FIGS. 4 and 5 has a concave portion 23 into which the connector main body 2 is put and the locking hooks 18 of the pair are provided on opposite sides of the concave portion 23. The locking hooks 18 pinch the second face 5B and the fourth face 5D which are shorter sides of the fitting coupling portion 5 having the rectangular plan shape and tip ends of the locking hooks 18 are locked to the fitting coupling portion 5. The locking hooks 18 protrude along the second face 5B and the fourth face 5D of the fitting coupling portion 5 from the first face 5A toward the third face 5C and the tip ends protrude from inner opposed faces to hook the third face 5C to be looked to the fitting coupling portion 5. The first holder 4A has guide spaces 20 for guiding the locking hooks 19 of the second holder 4B outside the locking hooks 18. The guide spaces 20 are formed by integrally molding guide ribs 21 for locking the locking hooks 19 of the second holder 4B.

The locking hooks 19 of the second holder 41 are inserted into the guide spaces 20 of the first holder 4A. The locking hooks 19 are locked to the guide ribs 21 provided to the guide spaces 20 of the first holder 4A to couple the second holder 4B to the first holder 4A. The locking hooks 19 of the second holder 4B are positioned on upper faces of the guide ribs 21 and tip ends of the locking hooks 19 are locked to end portions of the guide ribs 21 (see FIG. 6). In the locking hooks 19 of the second holder 4B, hook portions at their tip ends protrude downward to be locked to the end portions of the guide ribs 21. A width of each the locking hook 19 of the second holder 4B is substantially equal to a width of each the guide space 20, i.e., a clearance between each the locking hook 18 of the first holder 4A and an inner face of the concave portion 23 and the locking hook 19 is inserted into this clearance to be locked to the guide rib 21.

Figure 8:
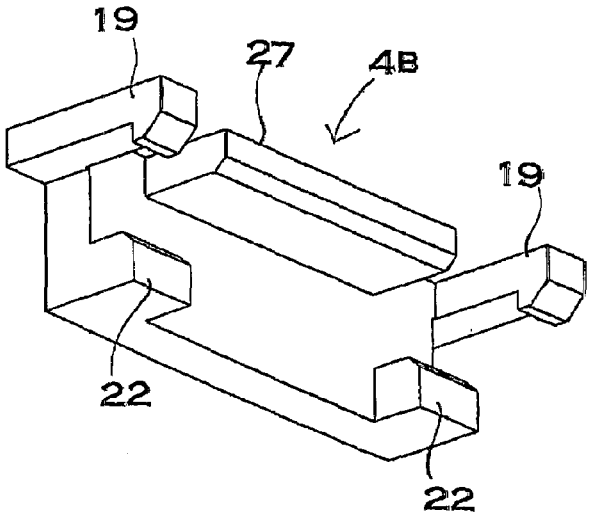
FIG. 8 is a perspective view of a second holder.

The first holder 4A has the integrally molded support portions 16 for pinching the coupling deck 8 of the connector main body 2 from opposite sides to support the coupling deck 8. In the connector main body 2 in the drawings, the support ribs 15 are provided to the coupling deck 8 and are supported by the support portions 16 provided under the support ribs 15. In the connector main body 2 shown in FIG. 5, the support ribs 15 are provided on the second face 5B and the fourth face 5D of the fitting coupling portion 5. The respective support ribs 15 extend to the end portions of the first face 5A and the third face 5C. In the first holder 4A, as shown in FIGS. 3 and 5, the support portions 16 for the support ribs 15 are provided on opposite sides of the concave portion 23. The support portions 16 protrude from the inner faces of the concave portion 23 and disposed under the support ribs 15. The second holder 4B has support portions 22 on their opposite side portions as shown in FIGS. 5 and 8. The support portions 22 are disposed below the locking hooks 19 and under the support ribs 15 (see FIG. 6). The second holder 4B has an upper face portion 27 having a substantially rectangular shape in a plan view on its upper face and a tip end side of the upper face portion 27 is in contact with the third face 5C of the fitting coupling portion 5 in a coupled state.

The first holder 4A has the coupling holes 11 for coupling the first holder 4A to the base 3 through the floating mechanism 10 at its opposite end portions. The elastic rings 12 are put into the coupling holes 11 to couple the first holder 4A to the base 3 through the setscrews 13. The floating mechanism 10 having this structure couples the connector 1 to the base 3 in such a manner that the connector 1 can be moved by deforming the elastic rings 12. However, in the present invention, the floating mechanism is not limited to the structure as shown in the drawings for coupling the connector to the base through the elastic rings which are rubber-like elastic bodies. Although it is not shown in the drawing, the floating mechanism may be a structure for coupling the connector to the base through springs or air cushions or with play in the floating mechanism. Although the coupling holes 11 for coupling the connector 1 to the base 3 through the floating structure are formed in the first holder 4A in the connector 1 of the above embodiment, the coupling holes may be formed in the second holder or both of the first holder and the second holder.

The above connector 1 is assembled as follows.

(1) The circuit board 14 is fixed by soldering to the connection terminals 6 of the connector main body 2 with the floating holder 4 separated from the connector main body 2. To the circuit board 14, a read wire connector 24 for coupling a flexible board 25 is fixed by soldering .

(2) One end of the flexible board 25 is coupled to the lead wire connector 24 and the other end of the flexible board 25 is coupled to a printed circuit board 26 fixed to the base 3. To the printed circuit board 26, the lead wire connector 24 is also fixed by soldering .

(3) As shown with an arrow in FIG. 5, the first holder 4A is coupled to the connector main body 2 in such a manner that the connector main body 2 is put into the concave portion 23. In this state, the locking hooks 18 of the first holder 4A are locked to the fitting coupling portion 5 of the connector main body 2. The support portions 16 are disposed on the lower faces of the support ribs 15 provided to the coupling deck 8 of the connector main body 2.

(4) Then, as shown with an arrow, the second holder 4B is inserted into the concave portion 23 of the first holder 4A. In this state, the second holder 4B is coupled to the first holder 4A with the tip ends of the locking hooks 19 locked to the guide ribs 21 of the first holder 4. Furthermore, the support portions 22 of the second holder 4B are disposed under the support ribs 15 of the coupling deck 8 to support the support ribs 15.

Through the above steps, the first holder 4A and the second holder 4B are coupled to the connector main body 2.

(5) The elastic rings 12 which are rubber-like elastic bodies are put into the coupling holes 11 in the first holder 4A and the setscrews 13 are inserted into the elastic rings 12 to couple the connector 1 to the base 3 through the setscrews 13.

As this invention may be embodied in several forms without departing from the spirit of essential characteristics there of, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims. This application is based on Application No.2004-234,763 filed in Japan on Aug. 11, 2004, the content of which is incorporated hereinto by reference.

What is claimed is:

1. A connector having a floating structure, the connector comprising:

a plurality of connection terminals for soldering and provided to a lower portion;

a fitting coupling portion for a portable electrical apparatus and having contacts to be coupled to the connection terminals to be connected to the portable electrical apparatus; and a floating holder for coupling the fitting coupling portion to a base through a floating mechanism, wherein the connection terminals and the fitting coupling portion are provided to a connector main body, the floating holder is molded of plastic as a separate part from the connector main body independently of the connector main body, the connector main body has a coupling deck for coupling the floating holder at its lower portion, the floating holder includes a first holder and a second holder for pinching and supporting the coupling deck of the connector main body from opposite sides, the first holder and the second holder have integrally molded locking hooks, to be coupled to each other directly or through the connector main body while pinching the coupling deck of the connector main body, the first holder and the second holder have integrally molded support portions, for supporting the coupling deck of the connector main body when the holders, are coupled while pinching the coupling deck of the connector main body, the connector main body is pinched between the first holder and the second holder of the floating holder, and the floating holder is coupled to the base through the floating mechanism.

2. A connector having a floating structure according to claim 1, wherein a metal sleeve is fixed in close contact with a periphery of the fitting coupling portion of the connector main body.

3. A connector having a floating structure according to claim 1, wherein the connector main body has the coupling deck at its lower portion and the coupling deck has a larger outside shape than the fitting coupling portion and is provided like a flange under the fitting coupling portion.

4. A connector having a floating structure according to claim 1, wherein the locking hook of the first holder hooks and locks the fitting coupling portion of the connector main body.

5. A connector having a floating structure according to claim 1, wherein the first holder has a concave portion into which the connector main body is put and the locking hooks of the pair on opposite sides of the concave portion.

6. A connector having a floating structure according to claim 1, wherein the first holder has a guide space for guiding the locking hook of the second holder outside the locking hook and the guide space has an integrally molded guide, rib for locking the locking hook of the second holder.

7. A connector having a floating structure according to claim 1, wherein the first holder has integrally molded support portions for pinching the coupling deck of the connector main body from opposite sides to support the coupling deck.

8. A connector having a floating structure according to claim 1, wherein the connection terminals are terminals to be coupled by soldering to a circuit board.

9. A connector having a floating structure according to claim 1, wherein an outside shape of the fitting coupling portion of the connector main body is a rectangular pole having a rectangular plan shape and the locking hooks of the first holder pinch shorter sides of the rectangle on opposite sides to thereby lock the fitting coupling portion.

10. A connector having a floating structure according to claim 1, wherein the locking hook of the second holder is locked to the first holder to thereby couple the second holder to the first holder.

11. A connector having a floating structure according to claim 1, wherein the floating mechanism couples the connector to the base by using an elastic ring which is a rubber-like elastic body put into a coupling hole in the connector so that the connector can be moved.

12. A connector having a floating structure according to claim 11, wherein the elastic ring is in a shape of a tube having flanges on its opposite ends and is inserted into the coupling hole so as not to withdraw.

13. A connector having a floating structure according to claim 12, wherein a setscrew is inserted into the elastic ring and couples the connector to the base.

14. A connector having a floating structure according to claim 1, wherein the coupling deck has an integrally molded support rib protruding from its outer periphery and the support rib is supported from below by the support portion provided to the floating holder.

15. A connector having a floating structure according to claim 14, wherein the coupling deck has support ribs along shorter sides of its rectangular shape.

16. A connector having a floating structure according to claim 14, wherein each the support rib has a bend chip (15A) formed by bending an outer peripheral edge of the support rib upward and is coupled by locking the bend chip (15A) by a hook ridge integrally molded on the floating holder.

17. A connector having a floating structure according to claim 1, wherein coupling holes for coupling to the base through a floating structure is formed in one or both of the first holder and the second holder of the floating holder.

18. A connector having a floating structure according to claim 17, wherein the first holder has the coupling holes for coupling to the base through the floating mechanism at its opposite end portions.

* * * * *